US008128518B1

(12) United States Patent
Kudla et al.

(10) Patent No.: US 8,128,518 B1
(45) Date of Patent: Mar. 6, 2012

(54) GOALIE TRAINING DEVICE AND METHOD

(75) Inventors: Michael J. Kudla, Groton, MA (US); David Cassidy, Chelmsford, MA (US)

(73) Assignee: Michael J. Kudla, Groton, MA (US)

( * ) Notice: Subject to any disclaimer, the term of this patent is extended or adjusted under 35 U.S.C. 154(b) by 1065 days.

(21) Appl. No.: 11/417,542

(22) Filed: May 4, 2006

Related U.S. Application Data

(60) Provisional application No. 60/677,784, filed on May 4, 2005.

(51) Int. Cl.
*A63F 9/24* (2006.01)

(52) U.S. Cl. ..... 473/478

(58) Field of Classification Search ..... 473/478
See application file for complete search history.

(56) References Cited

U.S. PATENT DOCUMENTS

| | | | | |
|---|---|---|---|---|
| 3,832,485 | A * | 8/1974 | Pieters | 348/593 |
| 4,749,189 | A | 6/1988 | Frank | 272/136 |
| 4,948,147 | A | 8/1990 | Pallanca | 273/402 |
| 4,995,607 | A | 2/1991 | Whitfield | 273/26 R |
| 5,271,624 | A | 12/1993 | Sciortino | 273/411 |
| 5,365,427 | A * | 11/1994 | Soignet et al. | 473/448 |
| 5,465,958 | A | 11/1995 | Brun | 273/57.2 |
| 5,509,650 | A | 4/1996 | MacDonald | 273/26 R |
| 5,584,481 | A | 12/1996 | Caluori et al. | 273/57.2 |
| 5,643,094 | A | 7/1997 | Macri et al. | 472/92 |
| 5,647,747 | A | 7/1997 | Macri et al. | 434/247 |
| 5,709,620 | A | 1/1998 | Reinprecht | 473/459 |
| 5,725,444 | A | 3/1998 | Heden | 473/446 |
| 5,800,312 | A | 9/1998 | Ormondroyd | 482/51 |
| 5,890,906 | A | 4/1999 | Macri et al. | 434/247 |
| 5,895,330 | A | 4/1999 | Reilly, Jr. | 473/446 |
| 5,982,352 | A * | 11/1999 | Pryor | 345/156 |
| 6,059,673 | A | 5/2000 | Mason | 473/478 |
| 6,073,489 | A | 6/2000 | French et al. | 73/379.01 |
| 6,098,458 | A | 8/2000 | French et al. | 73/379.04 |
| 6,164,973 | A | 12/2000 | Macri et al. | 434/247 |
| 6,308,565 | B1 | 10/2001 | French et al. | 73/379.04 |
| 6,331,168 | B1 | 12/2001 | Socci et al. | 600/595 |
| 6,430,997 | B1 * | 8/2002 | French et al. | 73/379.04 |
| 6,890,262 | B2 * | 5/2005 | Oishi et al. | 463/31 |
| 6,918,845 | B2 * | 7/2005 | Kudla | 473/478 |
| 2002/0121742 | A1 | 9/2002 | Stauber | 273/458 |

* cited by examiner

*Primary Examiner* — Omkar Deodhar
(74) *Attorney, Agent, or Firm* — Weingarten, Schurgin, Gagnebin & Lebovici LLP

(57) ABSTRACT

A goaltender training device provides a screen representative of a goal opening and an image capture device to detect a goaltender against the screen. The training device provides visual indicators of goal coverage and records goaltender stance and position relative to the screen to provide training feedback. The training device can provide a light source directed at the screen to enhance image capture and simplify image analysis. The image capture device defines a reference screen in memory to compare against obstructions of the screen during a training exercise. Particular points on the reference screen are identified for coverage by the goaltender during training, and coverage status of the points may be indicated with the visual indicators. Sequences of images can be analyzed for a particular parameter, such as percentage of the screen covered, and downloaded to other devices for review and analysis.

20 Claims, 6 Drawing Sheets

01 0.15

02 0.35

03 0.5

04 0.8

05 1.0

06 1.2

07 1.5

08 1.8

09 2.1

10 2.4

GOALIE TRAINING DEVICE AND METHOD

CROSS REFERENCE TO RELATED APPLICATIONS

This application claims benefit of Application No. 60/677,784, filed May 4, 2005.

STATEMENT REGARDING FEDERALLY SPONSORED RESEARCH OR DEVELOPMENT

N/A

BACKGROUND OF THE INVENTION

1. Field of the Invention

The present system and method relate generally to athletic training devices, and relates more particularly to a device for assisting the training of a goalie tending a goal.

2. Description of Related Art

Devices for training goalies are known for a variety of sports, including hockey, soccer, field hockey and so forth. One training device, illustrated in U.S. Pat. No. 6,918,845 to Michael J. Kudla discloses a goaltender training apparatus with an example directed to a hockey goal. The apparatus is located in front of the goal and directs a number of signals at the goal that are reflected back to signal detectors. When a detector receives a signal reflected from a point on the goal, the detector causes an associated indicator to be activated. By blocking the signal path, a goaltender can practice coverage of particular points for the goal, which may be related to where the apparatus is positioned.

One drawback of the above-discussed apparatus is that the apparatus must be reconfigured each time it is located at a different point in front of the goal. The signal transmitters are reconfigured to be directed at the desired reflecting point on the goal to set up a beam path for which a goaltender can practice coverage. In addition, it is difficult to repeat a goaltender training setup, or to obtain a record of open goal areas, for example, and how the goaltender may have changed stance or position to cover the area.

BRIEF SUMMARY OF THE INVENTION

In accordance with the present invention, there is provided a training device for goaltenders that operates based on image capture and analysis in relation to a target image representing a goal. The image capture may be achieved through video imaging, where a number of images, or frames, are captured or recorded, and transferred to various types of media for further review or analysis. A screen for enhancing image capture is placed in the goal as a background for the goaltender to indicate areas of desired coverage. An image capture unit is positioned in front of the goal and directed at the screen. The image capture unit may be placed at arbitrary locations in front of the goal within a general range of distance and angle to the goal. The image capture unit locates the screen within the goal after positioning, and can capture images of the screen with the goaltender tending the goal to determine areas of coverage by the goaltender.

In an exemplary embodiment, the screen may be made retro-reflective, and the image capture unit may be provided with a light source, so that the captured image with the goaltender and the screen is enhanced in detail or contrast, for example. The light source may be chosen according to particular applications, such as for outdoor use for outdoor soccer or lacrosse, for example. An example of a type of light source is infrared (IR) light that can be directed at the screen in the goal and retro-reflected to the image capture unit without distracting the goaltender. The light source can be provided as a diffuse light source, or a generally collimated light source, such as a laser beam, that can scan over the area of the screen. The image capture unit is adjusted or tuned to the particular type of light source used.

According to a feature of the disclosed system, particular points in the goal on the screen can be identified for particular focus during goaltender training. For example, upper corners of a goal can be identified with the image capture unit to test the goaltenders ability to cover these points and train the goaltenders for coverage of the points. A set of indicators may be provided to the goaltender that correspond to the designated points in the goal to inform the goaltender when those points are exposed or covered. For example, an array of visual indicators representative of points within the goal display to the goaltender or others the status of coverage of points within the goal that correspond to the visual indicators. By adjusting stance or position, the goaltender can block particular points and see the resulting coverage illustrated in the status of the visual indicators. A selector switch may be provided for choosing differing sets of points within the goal and corresponding visual indicators to train the goaltender in different situations, for example.

According to another aspect of the disclosed system and method, a technique for identifying the target area of the goal as defined by the screen is provided. The image capture unit is placed at the desired location and prompted to capture an image that includes the screen. The image capture unit locates the edges of the screen and uses the located edges to contribute to defining a target area for the goalkeeper to cover.

According to another aspect of the disclosed system and method, the image capture unit captures a number of frames while the goaltender performs various exercises for defending and covering the goal. The single or multiple frames are saved to a memory storage, where they can be reviewed and analyzed, or transferred to other devices for review and analysis, for example. The resulting sequence of goal coverage and indicator status contributes to informing the goaltender on previously conducted training exercises and the results of various positions or stances, or changes therebetween.

According to another feature of the disclosed system and method, the image capture unit times intervals of activity for the goaltender. The image capture unit provides an indicator to the goaltender at the beginning of a timed interval, such as a visual or audial indicator. The goaltender may then perform an exercise, such as moving from one position to another while maintaining a certain goal coverage, for example, and maintains a final position for a certain period of time. The image capture unit senses when the goaltender has ceased moving and provides a measure of the time interval from the start signal to the end of the goalkeeper movement. Other end point indicators can be used to terminate the time interval as well. The time interval may be provided as an indicator of the goaltender's ability or progress in training, for example.

According to another feature of the disclosed system and method, the image capture unit calculates a value related to how well the goaltender covers the goal. For example, the image capture unit calculates a percentage of coverage compared to total screen size to provide feedback to the goaltender for adaptive training.

DETAILED DESCRIPTION OF THE PREFERRED EMBODIMENTS

The present application claims benefit of U.S. Provisional Application No. 60/677,784, filed May 4, 2005, the entire contents of which is hereby incorporated herein by reference.

In accordance with the present invention, a goalie training device and method include an image capture unit directed at a target screen representing a goal target. The screen is erected in the goal to cover some or all of the open goal area. The image capture unit uses the screen as a reference target, and sets a reference goal image based on an image capture of the screen. Once the reference goal is established, an image captured with a goalie is compared against the reference screen to determine coverage of the goal area. A number of images can be taken as frames to produce a stop image sequence, or a video to contribute to goalie training, review and analysis.

Figure 1:
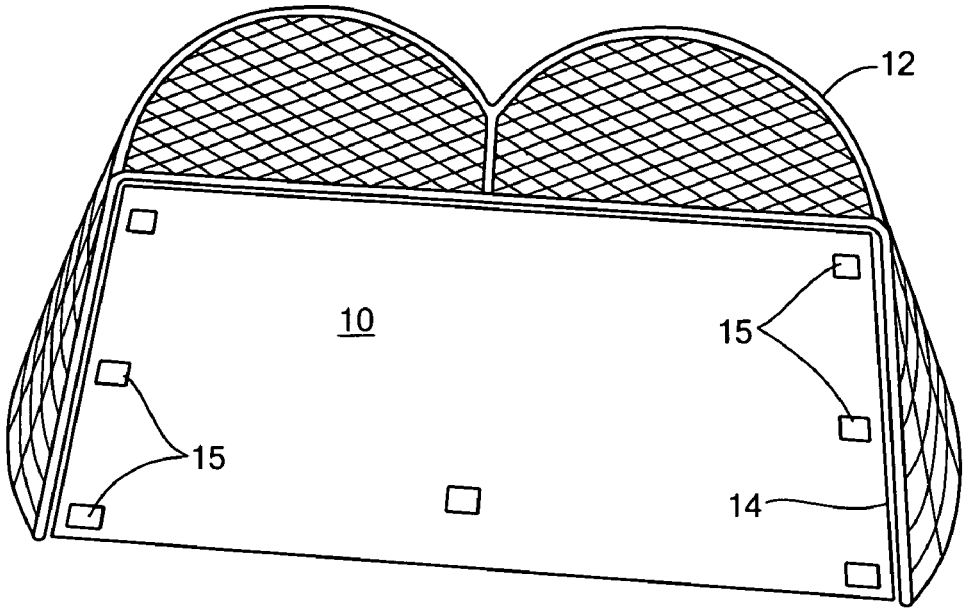
FIG. 1 is a perspective view of a goal with a screen in accordance with the present invention.

FIG. 1 illustrates a hockey goal 12 with an opening 14. A screen 10 is located in goal opening 14 and substantially covers an entirety of opening 14. Screen 10 need not cover the entirety of opening 14, but can be placed in portions of opening 14 to achieve desired training reference points, for example.

Figure 2:
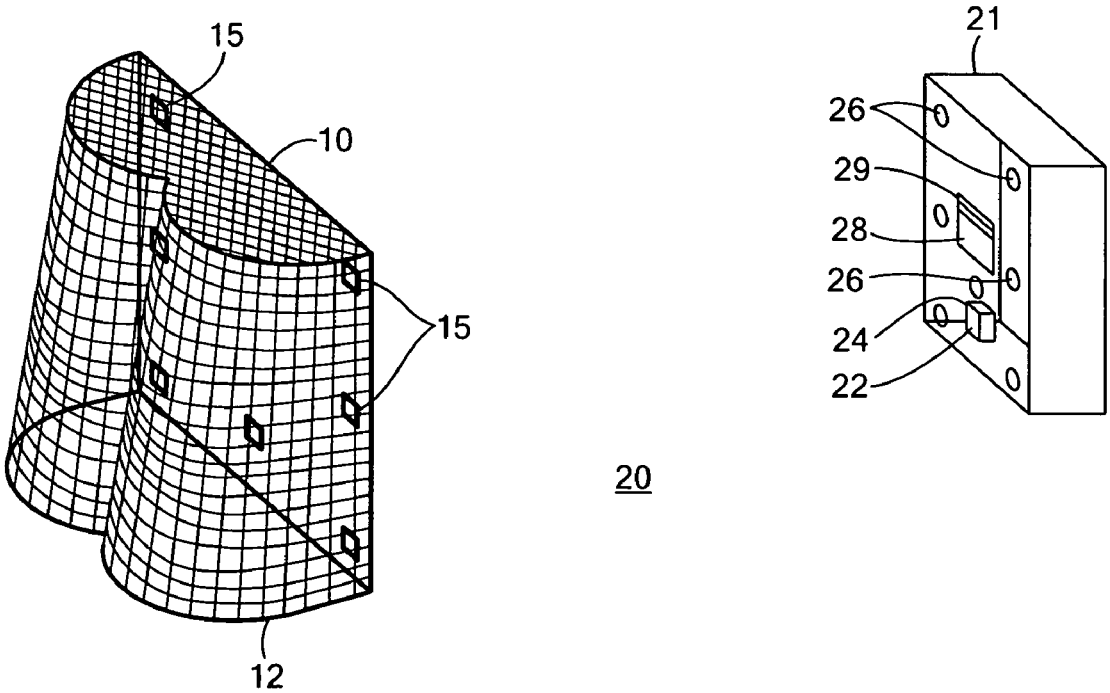
FIG. 2 is a perspective view of a goal with an apparatus in accordance with the present invention positioned with respect to the goal.

FIG. 2 illustrates a device 21 that operates in conjunction with screen 10 to assist in training a goalie. Device 21 includes an image capture unit 22, which may include a light source 24 for illuminating screen 10. Device 21 may optionally include visual indicators 26 that correspond to similarly located positions on screen 10. For example, indicators 26 can be turned on or off when a corresponding location on screen 10 is open or covered. Device 21 also may include a visual display 28 that can provide the goaltender with feedback, such as an indication of how the goaltender's stance and position covers the goal. A parametric display 29 may be used with device 21 to indicate a parametric value related to goal coverage. For example, display 29 may show a statistical percentage of coverage of the goal based on how much of screen 10 is blocked by the goaltender.

System 20 may operate in various modes depending upon its usage. For example, an initial mode can include a setup of device 21 in relation to screen 10. The setup may include positioning device 21 in relation to screen 10 and capturing an image of screen 10 without obstruction to contribute to calibrating image capture unit 22. Once image capture unit 22 is calibrated to set a reference goal area in memory, for example, a run mode may be engaged. The run mode may include capturing one or more images of screen 10 when blocked by the goaltender. The run mode may also permit activation of visual indicators 26 that correspond to predetermined targets 15 on screen 10. By blocking a path between targets 15 and image capture unit 22, corresponding visual indicators 26 are turned off or on to provide an instantaneous measure of goal coverage in relation to targets 15, as well as immediate feedback to the goaltender.

The run mode may also enable display 28 and/or parameter display 29 to provide additional feedback to the goaltender on coverage of screen 10. For example, display 28 may provide a real time video feedback to the goaltender to indicate open areas of screen 10. Display 28 may provide a gray scale or black and white real time video image with a high contrast to enhance the goaltenders perception of open areas of screen 10. Parameter display 29 may be provided in the form of a scale or bar graph, for example, to indicate a percentage of screen 10 covered by the goaltender.

Upon locating device 21 at a different position in front of goal 12, device 20 may be set to the initial mode to acquire an image of screen 10 to recalibrate a reference screen maintained by image capture unit 22. After completion of the initial mode, device 20 may be set to go into the run mode to again provide training assistance to the goaltender covering goal 12. The initial mode may be entered after power-up by providing a signal to image capture unit 22, such as through a button push, for example.

Screen 10 disposed in opening 14 of goal 12 may be composed of retro-reflective material that redirects an incident ray of light to the light source. In such a case, device 21 may include a light source that directs light at screen 10, so that received images obtained by image capture unit 22 can be enhanced with respect to interpretation of the parts of screen 10 that the goaltender may cover. The light source may be a diffuse light source, a flash or stroboscopic light source or a generally collimated scanning light source for example. In general, any type of light source with any type of characteristic may be used to enhance the image capture, however, considerations for interference with the goaltender's vision may be made. For example, the light source may be infrared (IR), so that it does not interfere with the goaltender's vision, or the goalie may take advantage of eyewear such as glasses or shields that can filter the light from the light source to avoid interfering with the goaltender's vision. In addition, screen 10 may be composed of a material that operates in conjunction with light source 24 to provide an enhanced image capture for image capture unit 22. For example, the light source can be used to cause a material on screen 10 to fluoresce or phosphoresce to improve image capture contrast. In the event light source 24 is a flash or stroboscopic source, image capture unit 22 can be timed to capture images at the same rate that light source 24 is flashed or strobed.

Figure 3:
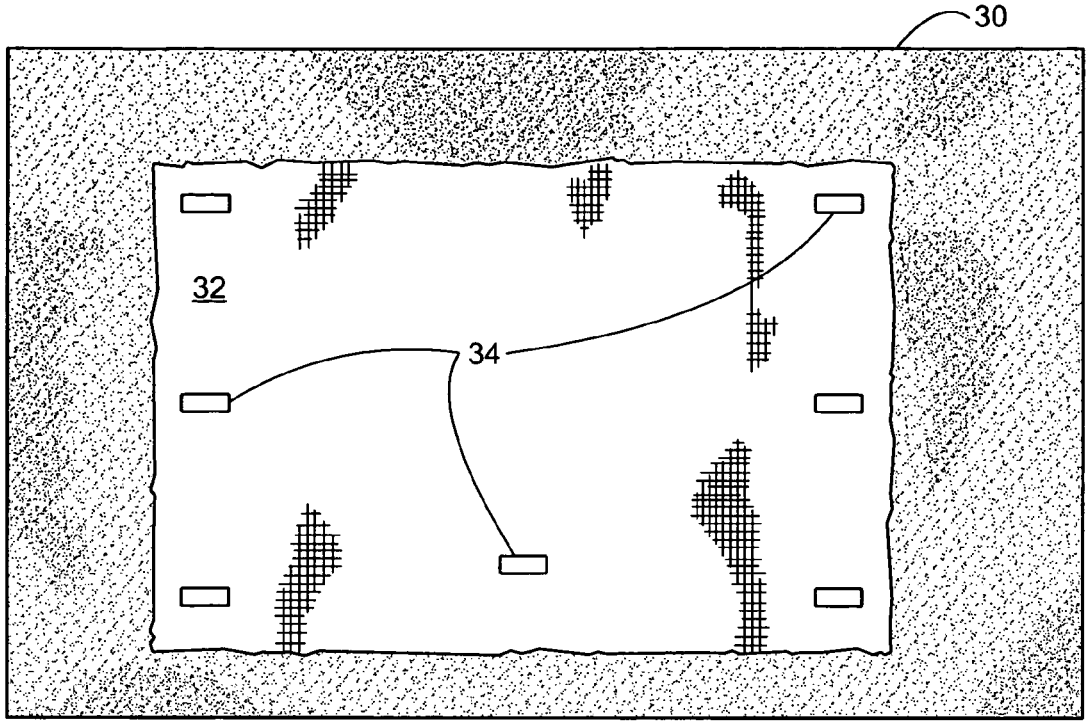
FIG. 3 is an illustration of an image frame showing a screen in accordance with the present invention.

FIG. 3 illustrates an image 30 captured by image capture unit 22. A screen 32 is clearly visible in image 30 for use in setting up the goaltender training device and a reference image screen. Once image 30 is captured in memory, various image processing techniques may be applied to make screen 32 appear uniform, such as by appearing completely white. Edges of the screen may be located in the image, with or without enhancement, to contribute to defining a reference screen for use with goaltender training when the goaltender is between image capture unit 22 and screen 10. Locations 34 can be defined for specific areas of screen 32 that are coordinated with visual indicators 26.

Image capture unit 22 has a number of image capture settings that may be adjusted depending upon a desired result and system parameters. For example, image capture unit may be tuned to the type of light source used to enhance the detection of screen 32. Image capture unit 22 may be adjusted to obtain an overexposed image, for example, to further contribute to providing contrast between screen 32 and the remainder of image 30. For example, the area within screen 32 can be made to be "washed out" to better depict the area of screen 32 in relation to the remainder of image 30. Image capture unit 22 may also adjust exposure and gain parameters based on a sample image taken during setup. Depending upon the light source and location, and type of screen 10 being used, image capture unit 22 can load a program to adjust image capture parameters to the environment. Parameters such as gain and exposure may be adjusted accordingly.

Figure 4:
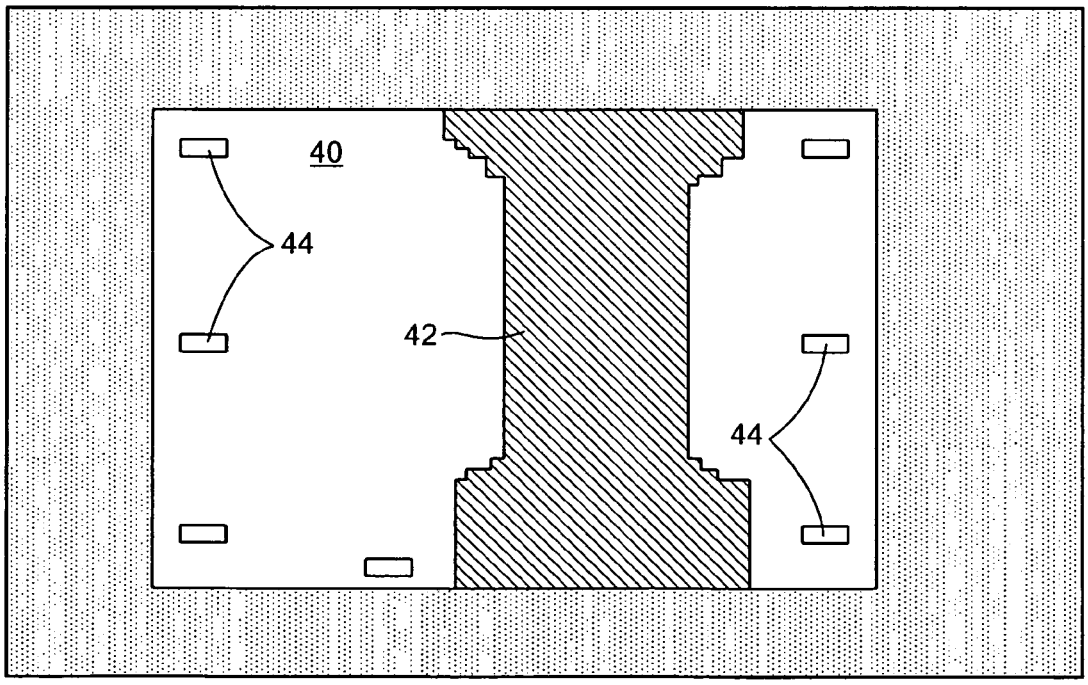
FIG. 4 is an image illustrating coverage of a goal defined by a screen in accordance with the present invention.

FIG. 4 shows a reference screen 40, together with an obstruction 42 representative of a goaltender. As can be seen in FIG. 4, reference screen 40 is well defined as a completely white area that is surrounded by well-defined lines representing the goal opening. Either screen 32 in FIG. 3 or reference screen 40 may be used by image capture unit 22 to define a virtual goal for the purposes of this disclosure and are referred to interchangeably as screen S in the following discussion. Screen S may include predetermined locations 34, 44 that represent particular areas of interest for providing goal coverage training. Locations 34, 44 can be mapped on screen S to correspond with visual indicators 26 that provide the goaltender with an indication of coverage for locations 34, 44. Visual indicators 26 can be operated in real time based on detection of coverage for locations 34, 44, for example by determining if the goaltender blocks locations 34, 44 so that screen S is obstructed at locations 34, 44. When locations 34, 44 are obstructed, image capture unit 22 provides a signal to permit visual indicators 26 to reflect the detected status of locations 34, 44 with respect to being open or covered.

Figure 7A:
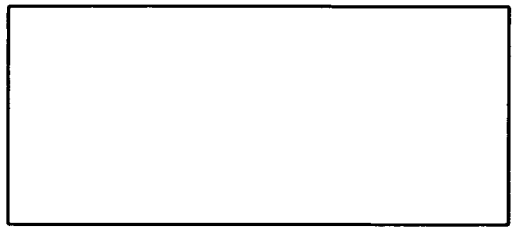
FIGS. 7*a*-7*d* are illustrations of activated visual indicator locations for feedback to the goaltender, which are selected on the basis of a selection input.
Figure 7B:
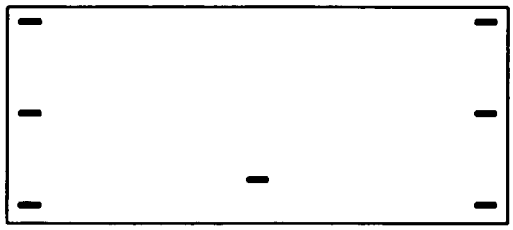
Figure 7C:
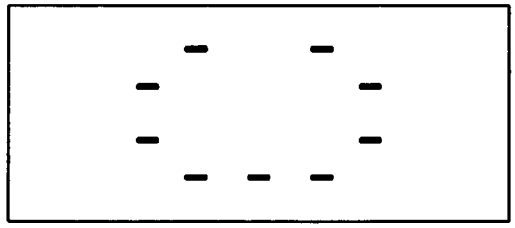
Figure 7D:
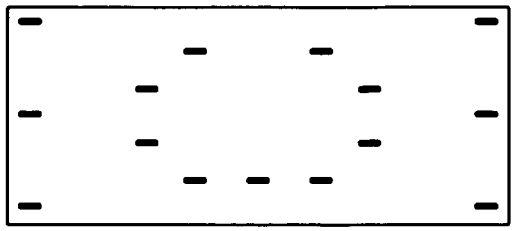

Device 21 includes a selection switch for indicating the pattern of visual indicators 26 that is enabled. Referring for a moment to FIGS. 7*a*-7*d*, the resulting patterns of visual indicators 26 reflect the status of the selection switch. In FIG. 7*a*, visual indicators 26 are disabled, so that even though locations 34, 44 may be defined in software, changes in status related to obstruction of locations 34, 44 are not communicated to visual indicators 26. In FIG. 7*b*, the selection switch enables a pattern of 7 visual indicators 26, and image capture unit 22 conveys obstruction status of locations 34, 44 related to enabled visual indicators 26 to corresponding visual indicators 26. In FIG. 7*c*, a pattern of 8 visual indicators 26 is enabled, an obstruction status of corresponding locations 34, 44 is communicated to the goaltender. FIG. 7*d* shows all 14 visual indicators 26 enabled.

Image capture unit 22 operates, for example during the initial mode, to locate top and bottom and left and right sides of screen S to define a virtual training area to be covered by the goaltender. For example, image capture unit 22 includes software to locate a generalized point within the screen S and searches across the captured image in a direction corresponding to an upper direction of the goal opening to locate a top of screen S. The software also searches downward to locate the bottom of screen S. One technique that may be used to find the top and bottom edges of screen S is to look for a large derivative in brightness between portions of the captured image. The top and bottom edges may be used to determine a middle of the screen in a vertical direction.

An assumption may be made with regard to the left and right edges of the screen that they are generally vertical, independent of an angle at which image capture unit 22 captures an image of screen 10. The software in image capture unit 22 searches for a left and a right edge of screen S to identify all borders of the screen. Once side edges are identified, top and bottom corners are located by searching upward or downward along a left and a right edge until a rapid change in brightness is detected, for example. Once corners of the screen are located, along with top, bottom, left and right edges, locations 34, 44 can be defined. The defined edges and corners may be adjusted within the representation contained in image capture unit 22 to improve tolerance in operations of device 20. For example, the corner and edge points may be adjusted inward slightly so that movement of the screen will not affect training operation with a goaltender.

Once screen S is located within the image representation, the system is ready for training operation. Device 21 may prompt the goaltender to move into a defense position and begin training exercises. Device 21 may also prompt the goaltender in various exercises in covering the goal area. For example, such visual signals or commands as "BE SQUARE," "GO TO THE PUCK" and "FOCUS" may be displayed on display 28. The commands may be issued in conjunction with a timing function, so that the goaltender may be prompted to begin the exercise. As the exercise begins, device 21 may turn visual indicators 26 on or off to permit the goaltender to attempt to cover the corresponding areas of the screen, or otherwise complete the suggested exercise indicated in the displayed command. During the time period following the prompt to the goaltender, image capture unit 22 captures one or more frames that can be reviewed or analyzed for coverage of the goal. For example, seven key spots, such as locations 15, may be checked to determine if they are covered. If the corresponding locations 34, 44 are covered so that the detected luminosity of locations 34, 44 drop significantly, an associated visual indicator 26 is turned on or off to indicate to the goaltender that the relevant point in the goal is covered. At the end of the exercise interval, which may be timed or determined by coverage parameters, for example, the image(s) is(are) analyzed with software that identifies the areas that are covered or uncovered by the goaltender. One result of the software analysis may be a percentage of the goal that is covered by the goaltender. A grayscale or black and white image can be projected on display 28 to provide feedback to the goaltender on coverage during the exercise interval.

The captured image(s) may be saved in the form of a filmstrip or video and made available for transfer to another display or download to another device. For example, a memory card or stick may be inserted into image capture unit 22 to obtain a record of images captured over the exercise interval. Alternately, or in addition, various communications links can be established between image capture unit 22 and other devices to download images or other information related to the exercise. Any type of communication links may be used to convey images or data from image capture unit 22 to another device, including standard interfaces, such as USB, RS232, wireless and so forth.

Device 21 permits the goaltender to be directed in different drills or movement patterns to test the ability of the goaltender to follow a predetermined path. For example, device 21 may prompt the goaltender to follow a predetermined path on the ice and block a maximum amount of screen area. Series of drills may be made available to prompt the goaltender through a number of exercise sequences that may move from one stance and position to another, or repeat exercises, for example. Device 21 also permits identification of a center of the net with a goaltender in position. Image capture unit 22 analyzes a captured image of the goaltender against screen S and finds a position between the goaltender's legs, such as may be indicated with an inverted "V" that can be related to screen S.

Figure 8A:
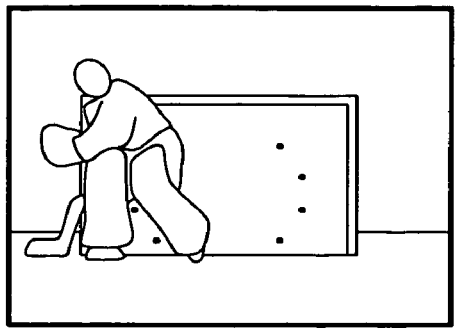
FIGS. 8*a*-8*k* illustrate frames during a goaltending exercise and a resulting parameter display.
Figure 8B:
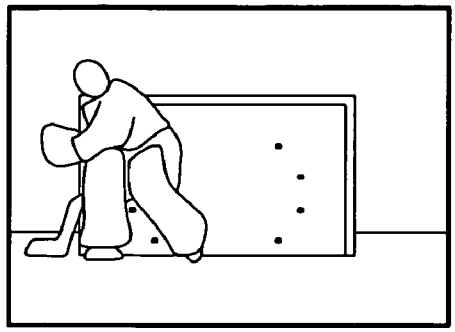
Figure 8C:
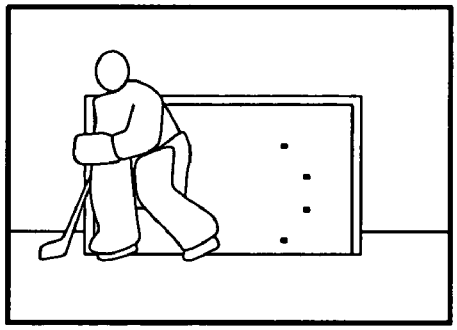
Figure 8D:
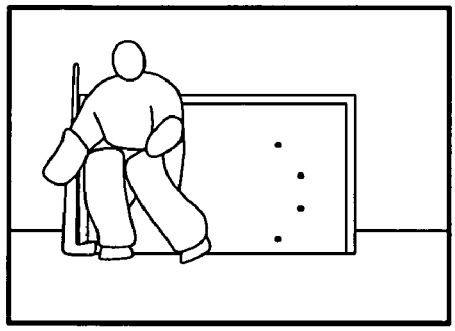
Figure 8E:
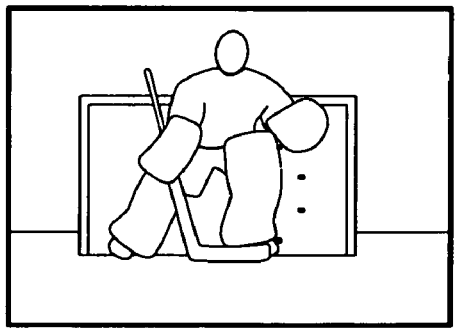
Figure 8F:
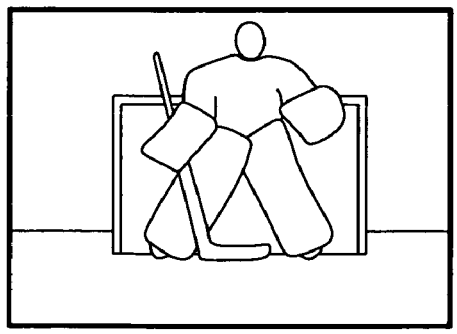
Figure 8G:
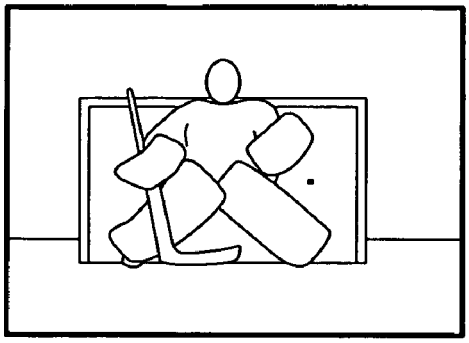
Figure 8H:
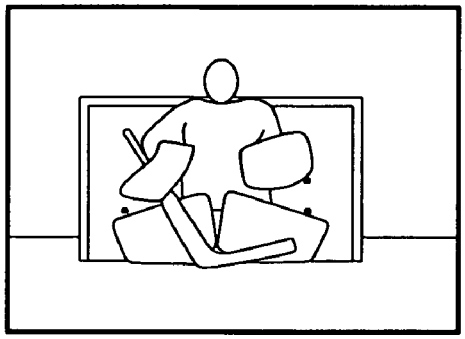
Figure 8I:
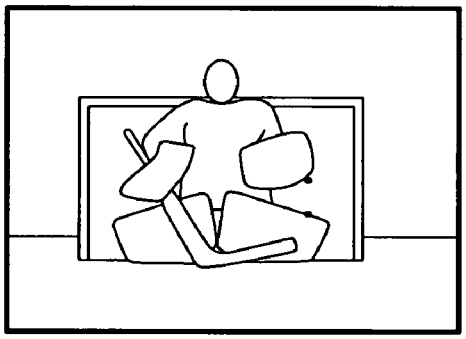
Figure 8J:
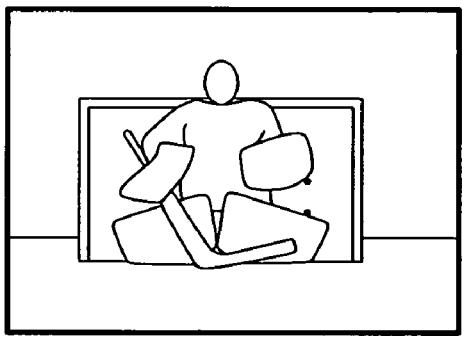
Figure 8K:
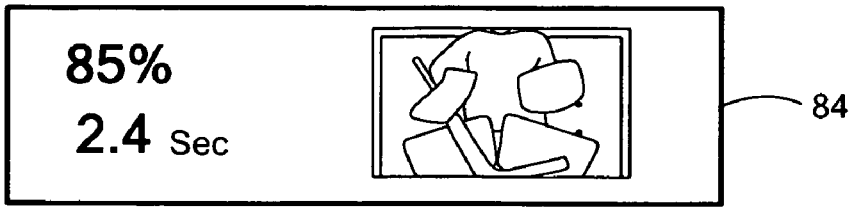

Device 21 also permits drills to be timed to provide additional training feedback. Referring for a moment to FIGS. 8*a*-8*k*, a series of images with time frames during a timed drill interval are illustrated. FIG. 8*k* shows the resulting feedback of time for the drill and percentage of goal covered at the end of the drill. Image capture unit 22 times the interval of activity during the drill, and stops timing once the goaltender maintains a position for a set amount of time, such as for ½ a second. Image capture unit 22 provides an indicator to the goaltender at the beginning of a timed interval, such as a visual or audial indicator, for example a tone or beep. The goaltender may then perform an exercise, such as moving from one position to another while maintaining a certain goal coverage, for example, as illustrated in FIGS. 8*a*-8*j*. Image capture unit 22 senses when the goaltender has ceased moving and provides a measure of the time interval from the start signal to the point at which the goaltender ceased movement. The measure of time may be shown on display 84. Other end point indicators can be used to terminate the time interval as well. The time interval may be provided as an indicator of the goaltender's ability or progress in training, for example.

Figure 5:
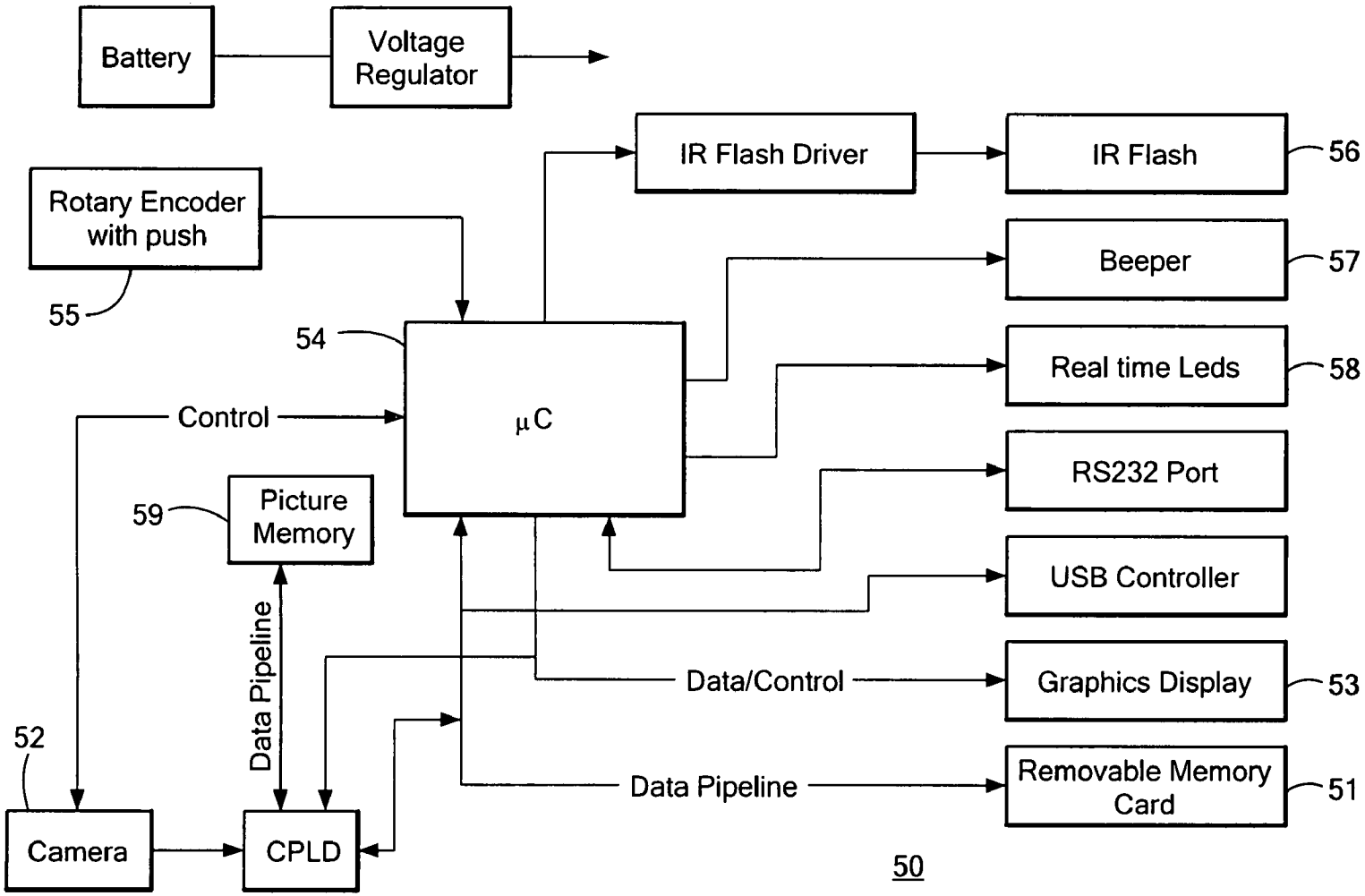
FIG. 5 is a block diagram illustrating a system architecture in accordance with the present invention.

FIG. 5 shows a block diagram 50 illustrating an architecture of the disclosed system. A camera 52 communicates with a microcontroller or microprocessor 54 to collect, transfer and analyze images. Architecture 50 illustrates an embodiment of the disclosed system in which an infrared (IR) light source is used in periodic intervals to produce an IR flash 56. Microprocessor 54 also controls visual indicators 26 in the form of real time LEDs 58. Architecture 15 may also include various types of memory including picture memory 59, removable memory card 51 and onboard memory within microprocessor 54. A graphic display 53 is also coupled to microprocessor 54 to provide image feedback, such as captured images or processed images. An input device 55 is coupled to microprocessor 54 to obtain input from an operator. Input 55 may be a button or rotary encoded button, for example. Architecture 50 also provides an audio output 57 coupled to microprocessor 54 to provide an audio prompt to the goaltender, which may be in the form of a tone or beep, for example.

In one embodiment, camera 52 produces up to 27 million pixels per second in captured images. The captured image data may be pipelined directly to picture memory 59 to rapidly produce a large number of captured images or frames. Picture memory 59 may also hold reference screen S, for example. Architecture 50 permits the CPU to multi-task, for example by activating real time LEDs 58 with appropriate status while camera 52 is in vertical retrace mode. Picture memory 59 is coupled to microprocessor 54 through a programmable logic device to permit captured images to be transferred to various other devices, such as memory card 51, or over various communication links. IR flash 56 is driven with a high-speed current source that contributes to providing adequate illumination even in the event of changes in battery voltages and LED temperature. IR flash 56 may be arranged in the form of a large array of IR LEDs to illuminate the screen to minimize LED power dissipation. Input 55 may be in the form of a rotary encoder with a push button that can scroll through menus and make selections to set up the system and enter data. The system may be powered with a 12 volt rechargeable battery that can be used to directly drive LEDs 58 and IR LEDs used in IR flash 56. A voltage regulator coupled to the battery may be used to provide a stable voltage supply, such as 3.6 volts, for use by microprocessor 54 and other various components of architecture 50. The microprocessor may permit the system to be turned off when it is not in use or in the event of low battery voltage.

Figure 6:
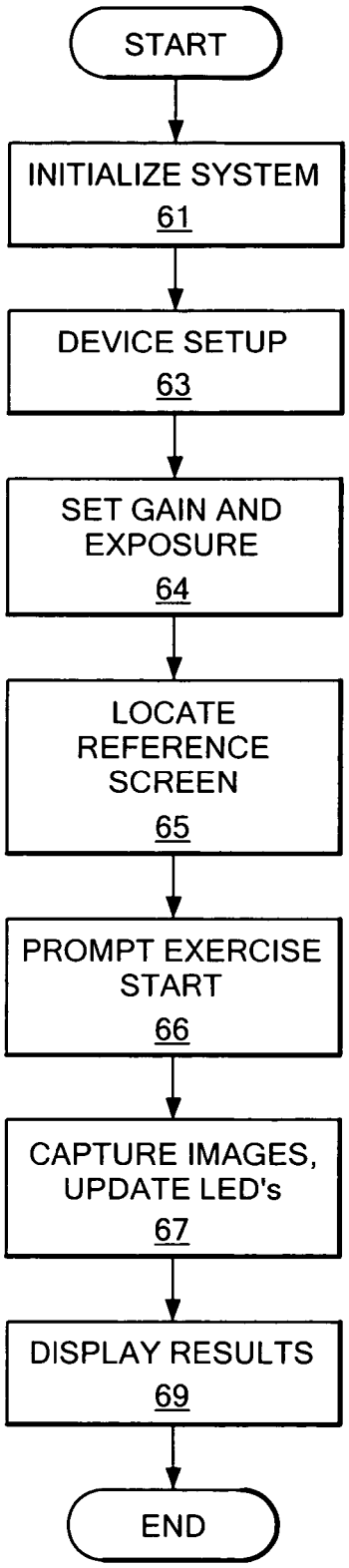
FIG. 6 is a flowchart showing operation of the system according to the present invention.

FIG. 6 provides a general abstract flow diagram for operation of the disclosed system in a general embodiment. The system is powered and initialized in a block 61, and provides a device setup operation in a block 63. Device setup corresponds to a beginning of the initial mode discussed above, for example. During the initial mode, the system can set a gain and exposure in a block 64 for capturing images with image capture unit 22. The gain and exposure are set and a sample image is taken, after which the gain and exposure are adjusted based on the sample and internal parameters. For example, the gain and exposure may be adjusted by a program provided in image capture unit 22. The program may provide parameters that can be adjusted based on the type of light source, the screen material, position and so forth. Accordingly, the gain and exposure may be adjusted in accordance with the system setup.

A block 65 provides for locating screen S in a captured image to set up a reference for a virtual goal. Locating screen S includes defining screen S attributes such as the location of the top, bottom, left and right sides of screen S. Midpoints and corners of screen S may also be located. Once screen S is located, the system may enter the run mode and begin training exercises.

A block 66 provides a prompt to the goaltender to begin the training exercise. The exercise may be a general exercise where the goaltender attempts to cover as much as possible of the goal area, or cover locations 34, 44 in a particular sequence, for example. As the exercise begins, images are captured and LED statuses are updated, as indicated in a block 67. Once the drill or exercise is over, or image capture unit 22 has recorded a given amount of information or timed a given interval, the results of the drill are displayed. The captured images are available for download or analysis, such as by giving a percentage of goal coverage.

It should be appreciated that variations of and modifications to the above-described goaltender training apparatus and method may be made without departing from the inventive concepts disclosed herein. Accordingly, the invention should not be viewed as limited except as by the scope and spirit of the appended claim

What is claimed is:

1. A goaltender training apparatus, comprising:

a background screen with a region representative of a portion of an opening of a goal;

an image capture device spaced from the background screen and directed at the background screen and being configured to capture and store an image of the background screen including the region;

a processor in the image capture device configured to define a reference screen in a captured and stored image in relation to the region; and the processor being configured to detect an obstruction of the region when a defensive player is located between the image capture device and the region based on a comparison between a captured image that includes the obstruction related to the defensive player location, and the reference screen.

2. The training apparatus of claim 1, further comprising a visual indicator configured to be actuated when the defensive player as the obstruction obstructs a path between the image capture device and a predefined location of the reference screen.

3. The training apparatus of claim 1, further comprising a light source directed at the region.

4. The training apparatus of claim 3, wherein the light source is infrared.

5. The training apparatus of claim 3, wherein the light source flashes.

6. The training apparatus of claim 1, further comprising a display configured to display an image taken or produced by the image capture device.

7. The training apparatus of claim 1, further comprising a parametric display configured to provide an indication of a value of a parameter associated with a training exercise.

8. The training apparatus of claim 1, further comprising a communication link coupled to the processor and configured to transfer images from the apparatus.

9. The training apparatus of claim 1, further comprising an input device coupled to the processor and configured to select data or commands for the apparatus.

10. The training apparatus according to claim 1, wherein the background screen further comprises a retroreflective surface.

11. A method for training a goaltender, comprising:

positioning a background screen to represent a region of a portion of an opening of a goal;

positioning an image capture device to be spaced from and directed at the background screen;

capturing and storing an image of the background screen including the region using the image capture device;

defining a reference screen in relation to the region with the image capture device; and detecting an obstruction related to a defensive player located between the image capture device and the region based on a comparison between a captured image that includes the obstruction and the reference screen.

12. The method according to claim 11, further comprising actuating a visual indicator when the defensive player obstructs a predefined location of the reference screen.

13. The method according to claim 11, further comprising directing a light source at the region.

14. The method according to claim 13, wherein the light source is infrared.

15. The method according to claim 13, wherein the light source flashes.

16. The method according to claim 11, further comprising displaying an image taken or produced by the image capture device.

17. The method according to claim 11, further comprising providing an indication of a value of a parameter associated with a training exercise.

18. The method according to claim 11, further comprising transferring images from the image capture device.

19. The method according to claim 11, further comprising selecting data or commands with an input to the image capture device.

20. The method according to claim 11, further comprising providing a retroreflective surface on the background screen.

* * * * *